US005784765A

United States Patent [19]

Fildan

[11] Patent Number: 5,784,765

[45] Date of Patent: Jul. 28, 1998

[54] PARTIAL-RELEASE FRONT CLOSURE FOR AN UPLIFT BRASSIERE

[76] Inventor: Gerhard Fildan, A. Baumgartnerstr. 44, C2211, A1230, Vienna, Austria

[21] Appl. No.: 855,681

[22] Filed: May 14, 1997

[51] Int. Cl.[6] ..... A44B 11/00

[52] U.S. Cl. ..... 24/615; 24/616; 24/630; 24/664; 24/647

[58] Field of Search ..... 24/615, 616, 614, 24/630, 647, 664

[56] References Cited

U.S. PATENT DOCUMENTS

| | | | |
|---|---|---|---|
| 1,205,247 | 11/1916 | Munroe | 24/614 |
| 2,912,984 | 11/1959 | Jensen | 24/616 |
| 3,196,878 | 7/1965 | Hedu | 24/615 |
| 3,200,464 | 8/1965 | Cousins | 24/616 |
| 3,430,306 | 3/1969 | Tareau | 24/615 |
| 4,425,689 | 1/1984 | Fildan . | |
| 4,631,784 | 12/1986 | Fildan . | |
| 4,712,280 | 12/1987 | Fildan . | |
| 4,791,709 | 12/1988 | Fildan . | |
| 4,843,689 | 7/1989 | Fildan . | |

*Primary Examiner*—Victor N. Sakran
*Attorney, Agent, or Firm*—Herbert Dubno

[57] ABSTRACT

A front closure for a brassiere, particularly a brassiere of the uplift type in which the male and female members are engaged with a resilient finger on the female member adapted to be held by first and second detents permitting relaxation of the closure without full separation but also permitting full separation for brassiere opening.

8 Claims, 5 Drawing Sheets

PARTIAL-RELEASE FRONT CLOSURE FOR AN UPLIFT BRASSIERE

FIELD OF THE INVENTION

My present invention relates to a partial-release closure for the front of an uplift brassiere and, more particularly, to a closure which allows full separation of the two sides or halves of an uplift brassiere at the front thereof, while enabling relaxation of the brassiere by partial release when desired.

BACKGROUND OF THE INVENTION

Partial closures for uplift type brassieres are, of course, well known and may utilize male and female interfitting members, hook and eye type systems or a variety of other closure types which are designed, when the brassiere is to be worn, to be coupled together to draw the two sides of the brassiere together to provide an uplift effect. For removal of the brassiere, the two parts can be decoupled, thereby separating the two brassiere cups.

In practice the uplift effect has been found to be highly constricting across the chest of the wearer so that, frequently, the wearer may find that continued constriction is so uncomfortable that the brassiere must be removed or else will become intolerable. Simple opening of the front closure, of course, not only loses the uplift effect, but renders the brassiere practically ineffective as a support and, if the occasion requires, the wearer may have to recouple the closure parts which may be inconvenient through a blouse, sweater or other garment.

OBJECTS OF THE INVENTION

It is, therefore, the principal object of the present invention to provide a front closure for a brassiere, particularly of the uplift type, whereby the afore described drawbacks can be obviated.

Another object of this invention is to provide a separable front closure for a brassiere which can be operated through a blouse or other garment of the wearer and which does not require opening of the blouse or reaching under a garment to permit operation of the closure.

Still another object of the invention is to provide an improved front closure for a brassiere which makes wearing of the brassiere more comfortable than has heretofore been the case.

SUMMARY OF THE INVENTION

These objects and others which will become apparent hereinafter are attained, in accordance with the invention, in an improved front closure for a brassiere, especially of the uplift type, comprising a male and a female member which can be joined by insertion of the male member into the female member and which has, in addition to its fully-connected position, a relaxed position in which the separation between the ends of the closure parts can be increased while the two parts remain connected together.

A typical front closure for a brassiere in the past has generally had a single detent whereby the male member engaged the female member until, for example, the male member was depressed by a finger of the wearer to release that detent and allow the parts to be decoupled.

According to the invention, however, a second detent is provided whereby, upon release of the first detent, the male member engages the female member at a second detent with a greater separation of the ends of the closure parts so that, for example, the brassiere can be held less tightly across the sternum of the wearer.

According to a feature of the invention, the female member is provided with a plate which bears against a resilient tongue of the male member in the fully-closed position of the closure, the plate being of a size such that it can be operated by a finger of the user directly through a blouse, sweater or other garment to release the first detent. The female member can also have a window, an edge of which is engaged by the tongue and forming the second detent, whereby the tongue can be depressed through the window when, for example, the overlying garment is removed, to allow full separation of the two closure parts.

It has been found to be advantageous to provide on the actuatable plate and on the male member decorative formations, the decorative formation on the male member being revealed through the window when the two parts are fully pressed together.

According to another feature of the invention each of the closure members can be provided with an eye through which a strap can be passed, or with a thin flexible portion through which the respective part can be stitched to the fabric of a respective brassiere cup. In the latter case it has been found to be advantageous to apply a fabric imitation pattern on the sewing flange so that, where the sewing flange is exposed, it will have the appearance of a fabric.

BRIEF DESCRIPTION OF THE DRAWING

The above and other objects, features, and advantages will become more readily apparent from the following description, reference being made to the accompanying drawing in which.

SPECIFIC DESCRIPTION

Figure 10:
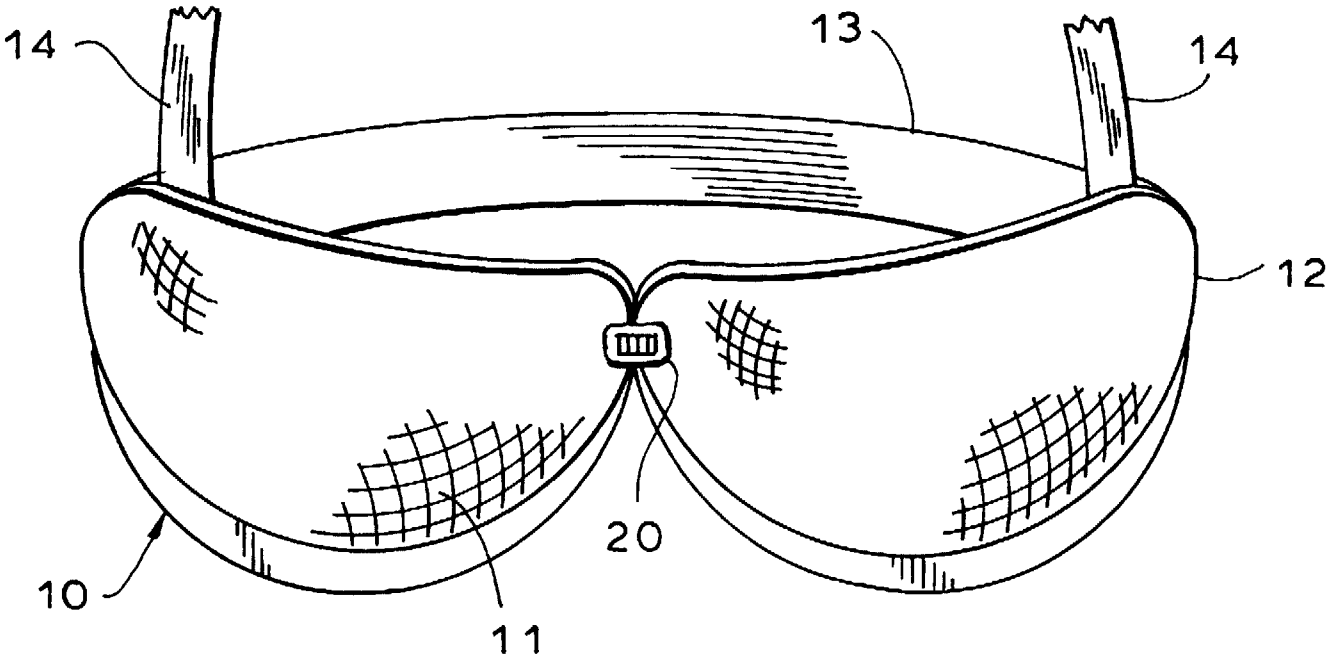
FIG. 10 is a perspective view of an uplift brassiere provided with the front closure of the invention.

In FIG. 10 I have shown a brassiere 10 of the uplift type comprising cups 11 and 12 at least in part composed of fabric and interconnected by a back 13 and provided with straps 14, if desired. The two cups 11 and 12 are interconnected by a separable front closure 20 which can be of the type described in connection with FIGS. 1–9 and which serves not only to permit separation of the cups so that the brassiere may be put on and taken off, but also, in the fully-closed position provides the tension desired for the uplift effect. The closure 20, however, has a relaxed position as will be described, in which the tension is partially relieved.

The closure 20 uses principles described in my U.S. Pat. No. 4,425,689.

Figure 1:
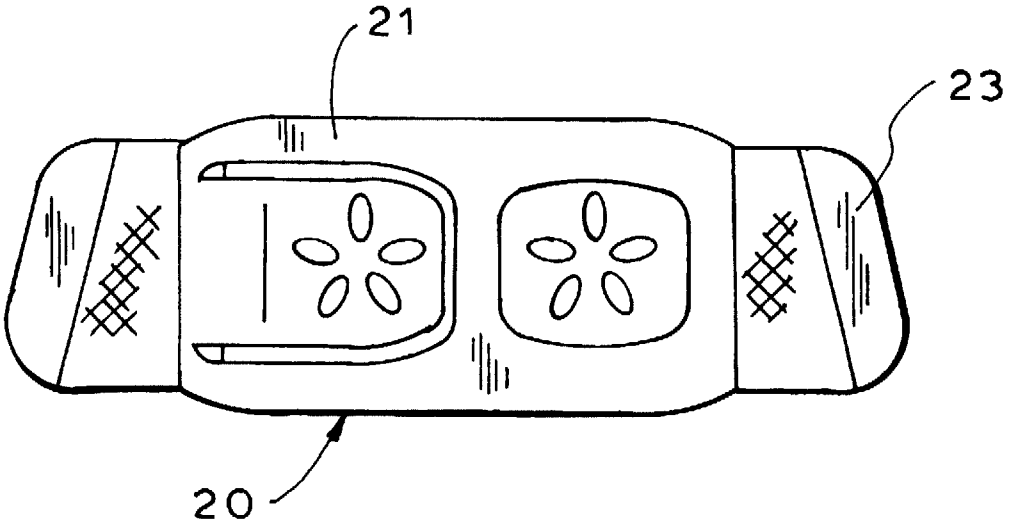
FIG. 1 is an elevational view of a fully-closed front closure for an uplift type brassiere according to one embodiment of the invention.

For example, in FIG. 1, I have shown a closure 20 which comprises a female member 21 and a male member 22, the latter having a sewing flange 23 which is provided with a fabric imitation pattern 24 and which has a tab 25 which can be stitched through for attachment, for example, to one of the cups 11, 12.

The male member 22 has an elongated tongue 26 which is formed with a resilient finger 27 and, between that finger and the sewing flange 23, is provided with a decorative panel 28. The decorative panel 28 is so located that it is positioned in registry with a window 30 formed in the body 31 of the female member which is elongated and has a slot capable of receiving the tongue 26. The resilient plate 32 is connected to the body 31 close to the sewing flange 33 which has a fabric patterned portion 34 as has been described and which can be stitched to the other cup of the brassiere. The plate 32 has an embossed pattern 35 which may match the pattern embossed on the panel 28 between the plate 32 and the end 36 receiving the tongue 26, the window 30 is provided.

Figure 7:
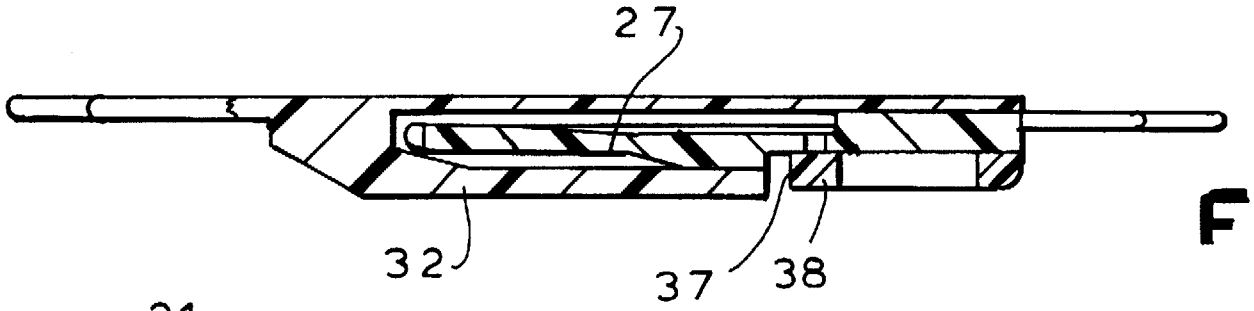
FIG. 7 is a longitudinal cross sectional view through the closure in its fully-closed and main contracted state.
Figure 8:
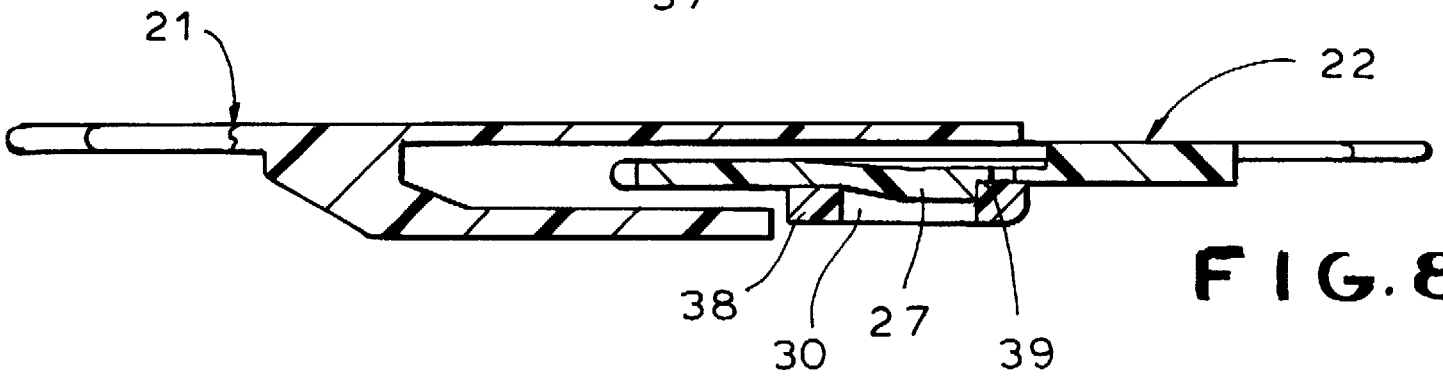
FIG. 8 is a longitudinal cross section through the closure in the partly-constricted state or relaxed state.
Figure 9:
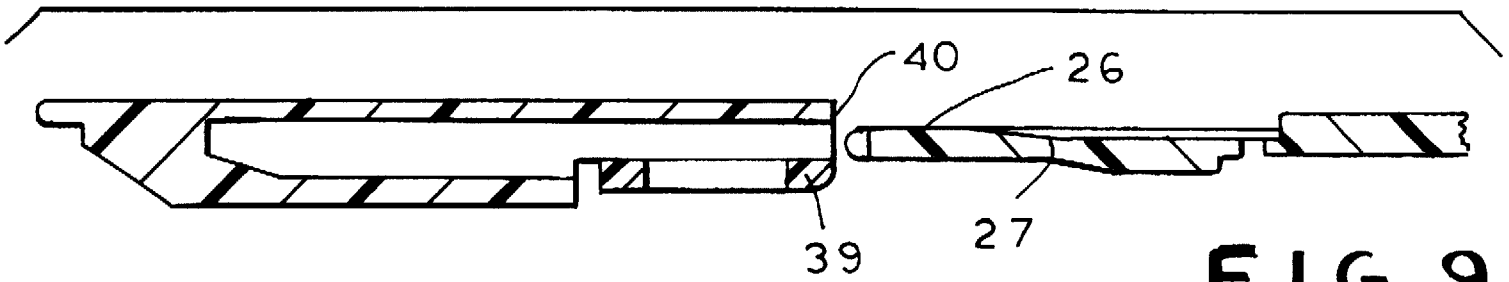
FIG. 9 is a longitudinal section showing the two parts of the closure fully separated from one another.

When the tongue 26 is fully inserted into the female member 21, the plate 35 is juxtaposed with the finger 27 as will be apparent from FIG. 7, so that the finger 27 can be deflected inwardly upon depression of the plate 32, e.g. through the blouse, sweater or other garment worn by the user over the brassiere. A notch 37 of the finger 27 can then be disengaged from a first detent 38 formed by one side of the window 30 (FIG. 7), thereby allowing partial separation of the male and female members 22 and 21 to achieve the position shown in FIGS. 2 and 8, where the finger 27 can engage a second detent 39 formed by a bar on the opposite side of the window 30.

In this relaxed position, with the closure expanded by say 10 mm, the brassiere is significantly more comfortable for the wearer although there is a partial loss of the uplift effect. Even without removing the over-garment, the wearer can restore the full uplift effect by simply pressing the male member 22 into the female member, until the finger 27 again engages the detent 38. When the brassiere is to be removed, the wearer need only press the finger 27 inwardly through the window 30 (FIGS. 2 and 8) to release the finger 27 from the detent 39 and allow the tongue 26 to be removed from the slot 40 (FIGS. 3 and 9) for full separation of the closure.

Figure 2:
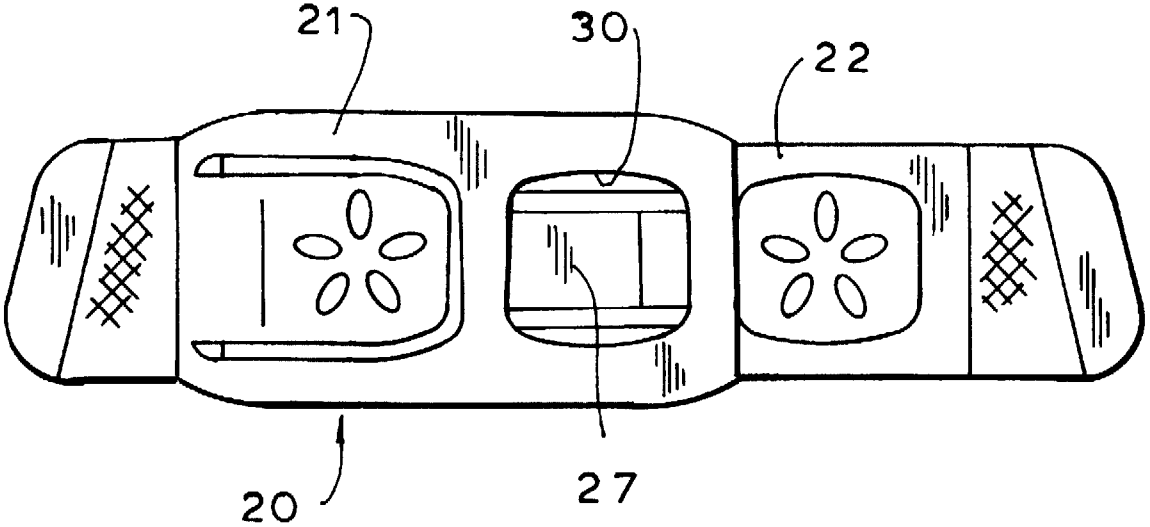
FIG. 2 is a view similar to FIG. 1 showing the partial released closure, i.e. the relaxed position thereof.
Figure 3:
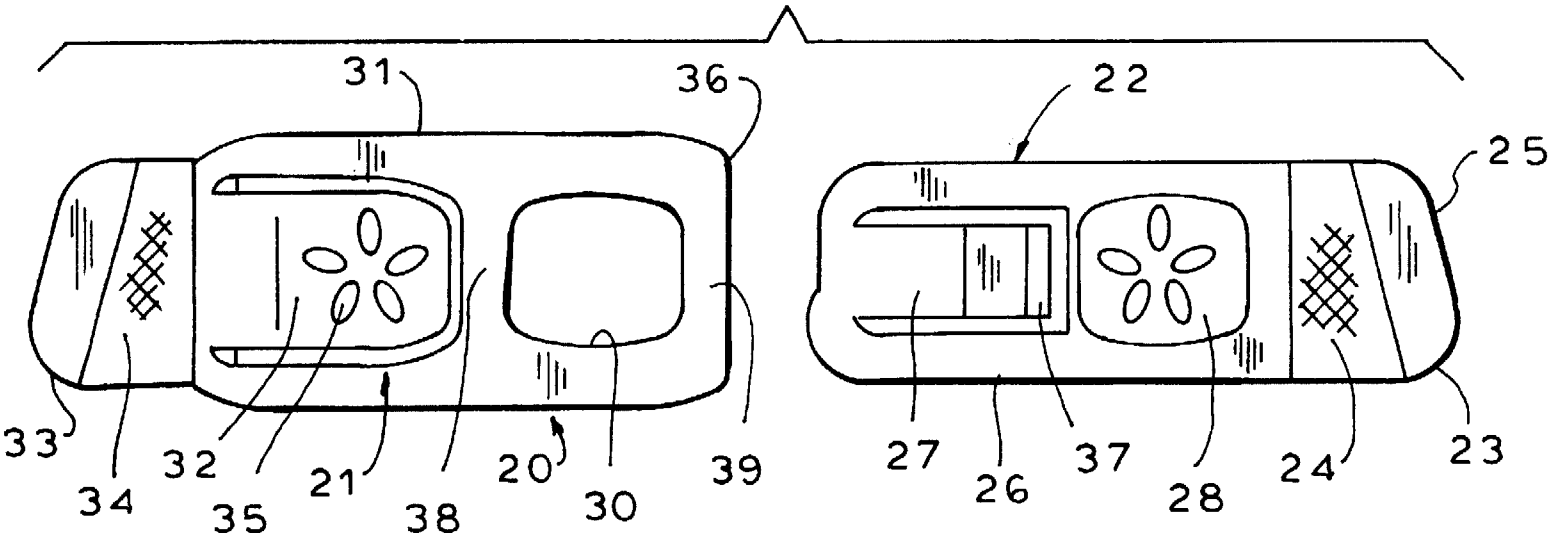
FIG. 3 is a view showing the fully-separated part of the closure.
Figure 4:
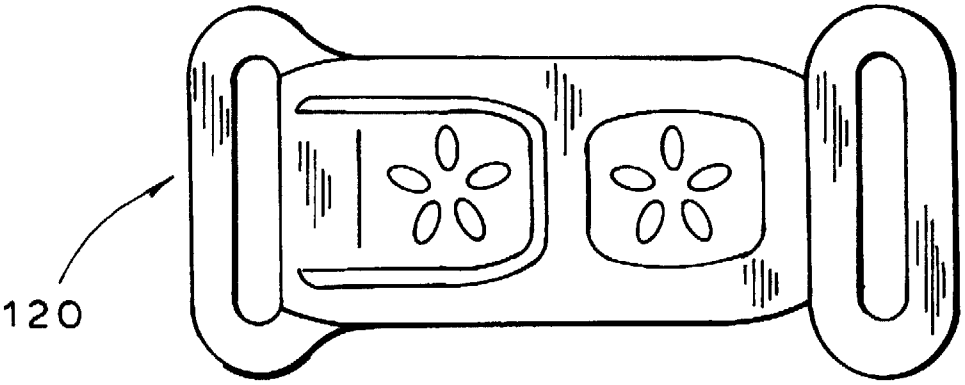
FIG. 4 is a view similar to FIG. 1 of a second embodiment of a front closure.
Figure 5:
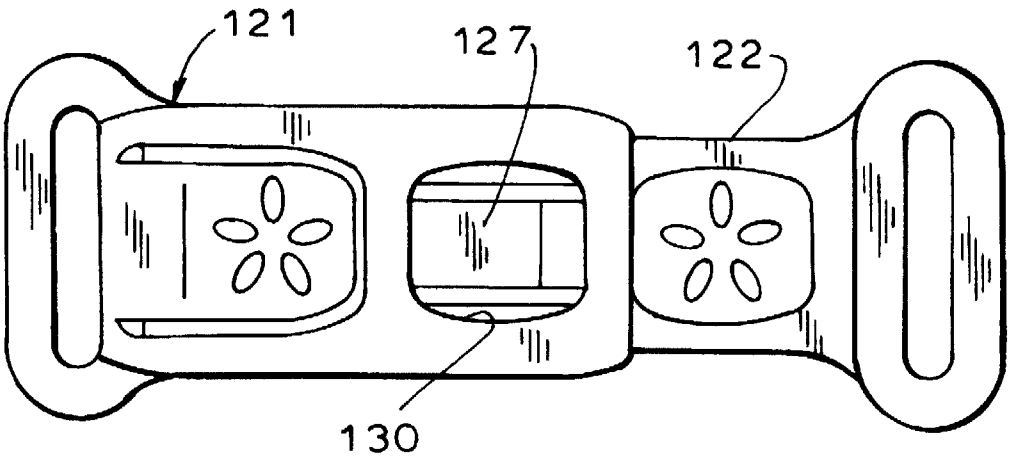
FIG. 5 is a view similar to FIG. 4 but showing the partially separated state of this latter closure.
Figure 6:
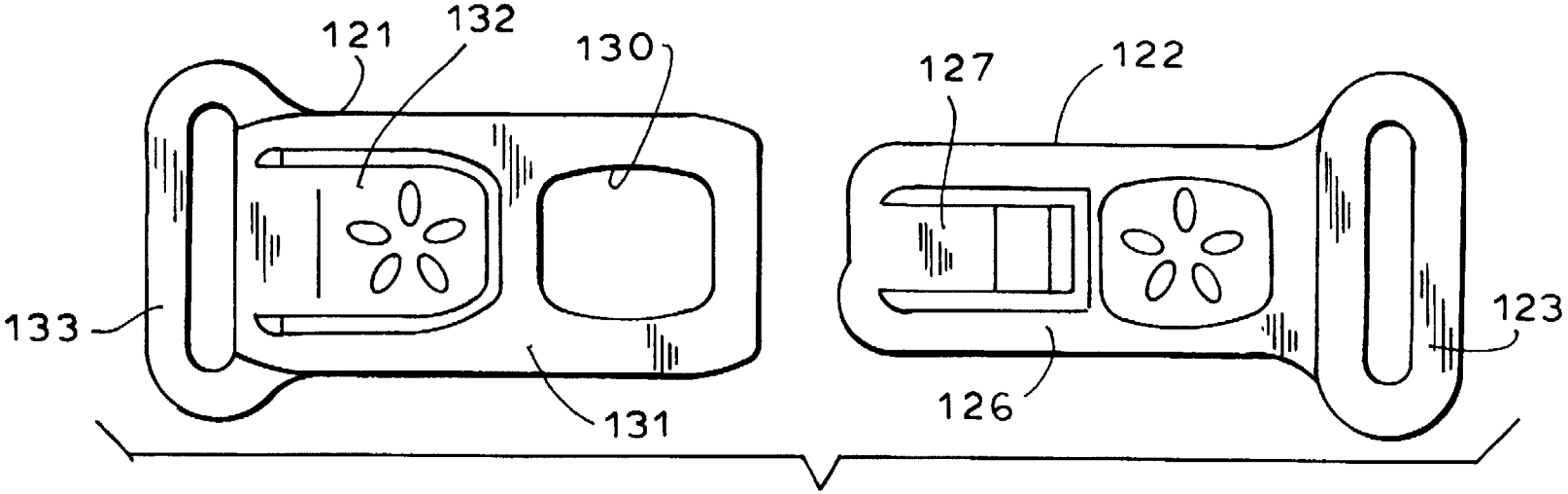
FIG. 6 is an elevational view showing the fully-separated state of the closure.

FIGS. 4–6 are analogous to FIGS. 1–3 but show a closure 120 wherein the female member 121 and the male member 122 are provided with strap eyes 133 and 123, respectively, for use of the closure in situations in which the two cups have respective straps which pass through these eyes and are stitched closed at the respective cups. As in the embodiment of FIGS. 1–3, the embodiment of FIGS. 4-6 comprises a tongue 126 on the male member whose finger 127 can be actuated by a plate 132 on the female member 121, the body 131 of which has a window 130 through which that finger 127 can be actuated to fully release the closure.

I claim:

1. A front closure for a brassiere comprising:

a female closure member having:

a flat elongated body having a slot at one end thereof, means at an opposite end of said flat elongated body for securing said female closure member to one cup of a brassiere, an actuating plate extending from said opposite end partly across a face of said body toward said one end, a window formed in said face between said plate and said one end, and a first detent formed on said body at one side of said window proximal to said plate and a second detent formed on said body proximal to said one end thereof; and an elongated male closure member having:

a tongue receivable in said slot, a resilient finger on said tongue engageable with said first detent in a position of said finger behind said plate, whereby said plate is actuatable to deflect said finger out of engagement with said first detent and said finger is engageable with said second detent upon partial withdrawal of said tongue from said slot, said finger being exposed through said window upon engagement of said finger with said second detent, and means for securing said male closure member to another cup of said brassiere.

2. The front closure defined in claim 1 wherein said first and second detents are bars of said body flanking said window.

3. The front closure defined in claim 2 wherein said means for securing said closure members to said cups include sewing flanges through which said closure members can be stitched to said cups.

4. The front closure defined in claim 3, further comprising an imitation fabric pattern embossed on each of said flanges.

5. The front closure defined in claim 2 wherein said means for securing said closure members to said cups include eyes adapted to be traversed by straps of said cups.

6. The front closure defined in claim 2, further comprising an embossed decorative panel on said tongue exposed through said window in a position of said members wherein said finger engages said first detent.

7. The front closure defined in claim 2, further comprising a decorative embossment on said plate.

8. The front closure defined in claim 2 wherein each of said members is molded in one piece from a synthetic resin.

* * * * *